US008430001B2

(12) United States Patent
Ortiz

(10) Patent No.: US 8,430,001 B2
(45) Date of Patent: Apr. 30, 2013

(54) FRANGIBLE COLLAR FASTENER AND NUT RETRIEVAL SOCKET

(75) Inventor: Steven Ortiz, Lake Elsinore, CA (US)

(73) Assignee: Northrop Grumman Corporation, Falls Church, VA (US)

( * ) Notice: Subject to any disclaimer, the term of this patent is extended or adjusted under 35 U.S.C. 154(b) by 192 days.

(21) Appl. No.: 13/155,326

(22) Filed: Jun. 7, 2011

(65) Prior Publication Data

US 2011/0296961 A1 Dec. 8, 2011

Related U.S. Application Data

(60) Provisional application No. 61/352,265, filed on Jun. 7, 2010.

(51) Int. Cl.
*B25B 13/02* (2006.01)

(52) U.S. Cl.
USPC ..... 81/124.1; 81/125

(58) Field of Classification Search ..... 81/124.1, 81/125, 55, 56
See application file for complete search history.

(56) References Cited

U.S. PATENT DOCUMENTS

| | | | | |
|---|---|---|---|---|
| 847,596 | A | 3/1907 | McMurtry | |
| 2,611,289 | A | 9/1952 | Frank | |
| 5,640,889 | A * | 6/1997 | Anderson | 81/125 |
| 5,855,150 | A * | 1/1999 | Otero | 81/124.1 |
| 6,557,727 | B1 | 5/2003 | Robertson | |
| 6,634,261 | B1 | 10/2003 | Griffin | |

OTHER PUBLICATIONS

Hi-Shear Corporation: Installation Tooling, Super HLA1076 2 inch offset driver assembly with multi-length socket and super-key (T-Series); J.R. Potter and Associates website and catalog; http://www.toolsforaircraft.com.

Roller Ratchet Square Drive for Installation and Removal & Roller Ratchet with Stepped Socket for Installation; Omega Technologies; http://www.toolsforaircraft.com.

Hi-Lok Fastening System (HL); http://www.hi-shear.com/fastener_hl.htm.

* cited by examiner

*Primary Examiner* — David B Thomas
(74) *Attorney, Agent, or Firm* — Stetina Brunda Garred & Brucker

(57) ABSTRACT

A socket is disclosed for securing frangible collar fasteners to bolts, and collecting the separated nut portions of the fasteners to avoid introducing debris into the work area. The socket comprises the socket housing having a first end formed to receive and engage the frangible nut portions, and the second end to receive and engage a ratchet. At least one retention member is disposed within the socket housing, proximate the housing first end. The retention member is resiliently displaceable to allow each nut portion to enter into the socket housing during fastening, and to retain a plurality of nut portions within the socket housing after the nut portions have been separated from the frangible collar fasteners. Nut ejection apparatus is provided having a first portion disposed exterior to the socket housing and a second portion disposed interior to the socket housing. The nut ejection apparatus is translatable along at least a portion of the socket length, to store a plurality of separate nut portions within the housing. The nut ejection apparatus further being manually translatable to urge the stored nut portions past the retention member and out of the socket first end.

10 Claims, 4 Drawing Sheets

FRANGIBLE COLLAR FASTENER AND NUT RETRIEVAL SOCKET

CROSS-REFERENCE TO RELATED APPLICATIONS

This application claims priority to provisional application Ser. No. 61/352,265 filed on Jun. 7, 2010 for Frangible Collar and Nut Retrieval System.

STATEMENT RE: FEDERALLY SPONSORED RESEARCH/DEVELOPMENT

Not applicable.

BACKGROUND

Frangible collar fasteners are commonly used in a variety of applications such as aircraft and aerospace applications. The frangible collar fasteners include a bolt engaging portion which is threadably engagable to a bolt, and a frangible nut portion which facilitates tightening of the bolt engaging portion to the bolt. The frangible nut portion is designed to break off from the fastener after it has been tightened to a defined torque. As a result, the bolt engaging portion remains secured to the bolt and the separated nut portion can drop to the surrounding work area, or otherwise fall as debris into the structure being constructed. Where the structure includes areas of limited access, such as a wing box or other confined space, it may be difficult to recover the nut portions after they become separated from the fastener. Given the potential harm that such loose debris can cause to mechanical avionics systems, weapons systems, fuel systems and the like, is imperative that such debris is not allowed to remain loose within the structure.

The present invention is directed to an apparatus for tightening frangible collar fasteners and retaining the separated portions of the fasteners in a reliable manner that avoids introduction of debris into the work area. The present invention is intended to capture a plurality of separated nuts within a single socket that can be used to tighten the fastener. As such, a plurality of fasteners can be tightened without needing to discharge each collected fastener one at a time. As a result, the invention provides a reliable apparatus for tightening fasteners and storing the separated nut portions in an efficient manner that enhances safety and allows improved production rates.

Further details of the invention are set forth below and described in connection with the accompanying drawings.

BRIEF SUMMARY

A socket is disclosed for securing frangible collar fasteners to bolts, and collecting the separated nut portions of the fasteners to avoid introducing debris into the work area. The socket comprises the socket housing having a first end formed to receive and engage the frangible nut portions, and the second end to receive and engage a ratchet. At least one retention member is disposed within the socket housing, proximate the housing first end. The retention member is resiliently displaceable to allow each nut portion to enter into the socket housing during fastening. The retention member also functions to retain a plurality of nut portions within the socket housing after the nut portions have been separated from the frangible collar fasteners.

Nut ejection apparatus is provided having a first portion disposed exterior to the socket housing and a second portion disposed interior to the socket housing. The nut ejection apparatus is translatable along at least a portion of the socket length, to reserve and store a plurality of separated nut portions within the housing. The nut ejection apparatus further being manually translatable to urge the stored nut portions past the retention member and out of the socket first end.

In the preferred embodiment the socket is provided with at least one slot extending along the portion of length of the socket housing, the nut ejecting apparatus extending through the slot to guide translation of the nut ejection apparatus along the socket length. In a preferred embodiment the socket housing comprises two slots.

The nut ejection apparatus first portion comprises an exterior nut ejection sleeve, disposed about the socket housing and translatable along at least a portion of the socket length.

The nut ejection apparatus second portion preferably comprises an interior nut ejection sleeve, disposed within the socket housing. The interior nut ejection sleeve is engaged to the exterior nut ejection sleeve and translatable therewith.

The nut ejection apparatus preferably comprises at least one pin, extending through the at least one slot, for connecting the exterior ejection sleeve and the interior nut ejection sleeve.

The socket housing second end preferably defines a ratchet engaging aperture, the socket being rotatable in response to a rotation of the ratchet to tighten the fasteners and to separate the frangible nut portions from the fasteners.

The socket first end portion preferably defines a substantially hexagonal interior chamber extending along at least a portion of the socket length from the socket first end. The hexagonal chamber is sized being formed to receive and store a plurality of frangible nut portions.

The socket second end portion preferably defines a substantially rectangular inner chamber extending a portion of the socket length from the socket second end, the substantially rectangular chamber being defined to receive and engage the ratchet.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The above description is given by way of example, and not limitation. Given the above disclosure, one skilled in the art could devise variations that are within the scope and spirit of the invention disclosed herein, including various ways of detecting and responding to fault conditions, e.g. depending upon the input signal parameters. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
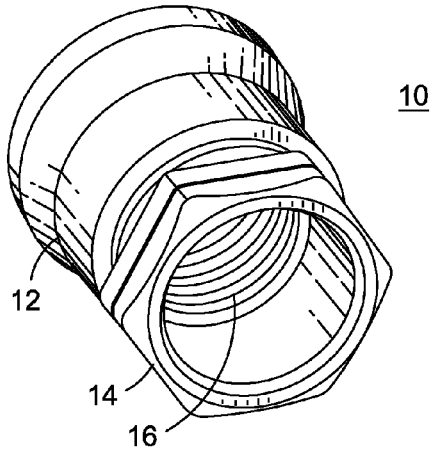
FIG. 1 is a perspective view of an exemplary frangible fastener, including a bolt engaging portion and a frangible nut portion.

FIG. 1 illustrates a frangible fastener 10 including an inner bolt engaging portion 12 and an outer frangible nut portion 14. The bolt engaging portion 12 includes internal threads 16 for receiving and engaging a bolt (see FIG. 5). The fastener 10 is secured to the bolt by rotation of the outer nut portion 14. When the fastener is secured to the bolt, further rotation of nut portion 14 will cause the nut portion to separate from the fastener 10. The nut portion 14 will then be retained in the socket 20 as described below.

Figure 2:
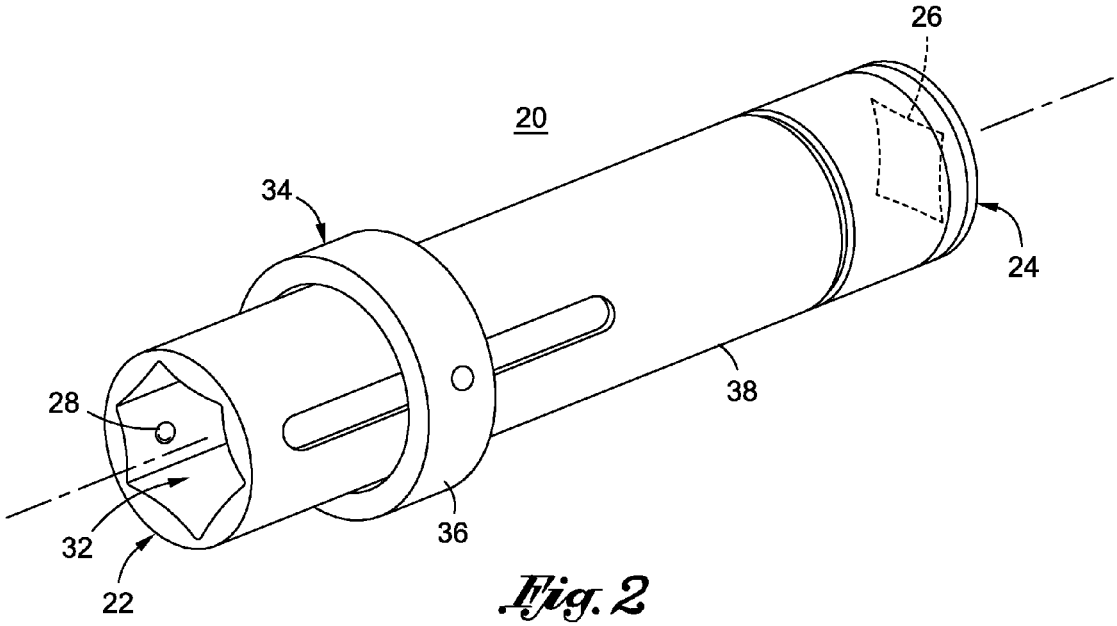
FIG. 2 is a perspective view of a frangible collar fastener and nut retrieval socket in accordance with the present invention.

FIG. 2 illustrates an exemplary frangible collar and nut retrieval socket 20 in accordance with the present invention. The socket includes a first end 22 formed to receive and engage the frangible collar nut portion 14. The socket 20 further includes a second end portion 24 defining a rectangular socket receiving aperture 26. As further shown on FIG. 5, the socket functions to secure the fastener 10 to a bolt 30 in response to rotation of ratchet 40.

As also shown on FIG. 2, the socket 20 includes at least one resilient retention member 28 extending into nut receiving aperture 32. In the preferred embodiment tow (2) retention members are disposed on opposite sides of the nut receiving aperture 32. The retention member 28 is displaceable to allow frangible nut 14 to enter into and engage nut receiving aperture 32. As the nut travels past the retention member(s) 28, the retention member(s) return to their original position extending into the nut receiving aperture 32. Multiple nuts can be stored in the housing 38, with each additional nut urging the other nuts further into the housing. As a result, when each nut 14 is separated from fastener 10, the nut remains within the socket housing 38 unless ejected as described below.

As shown in FIG. 2, socket 20 includes nut ejection apparatus 34 for ejecting one or more nuts that have been separated from the associated fasteners 10, and retained within the socket housing. The nut ejection apparatus 34 includes collar 36 which extends about socket housing 38, and is translatable along the length of housing 38. As described in more detail below, translation of the sleeve 36 towards the socket first end 32 will urge nuts 14 stored within the socket to displace the resilient member 28, and discharge the nuts from the socket.

Figure 3:
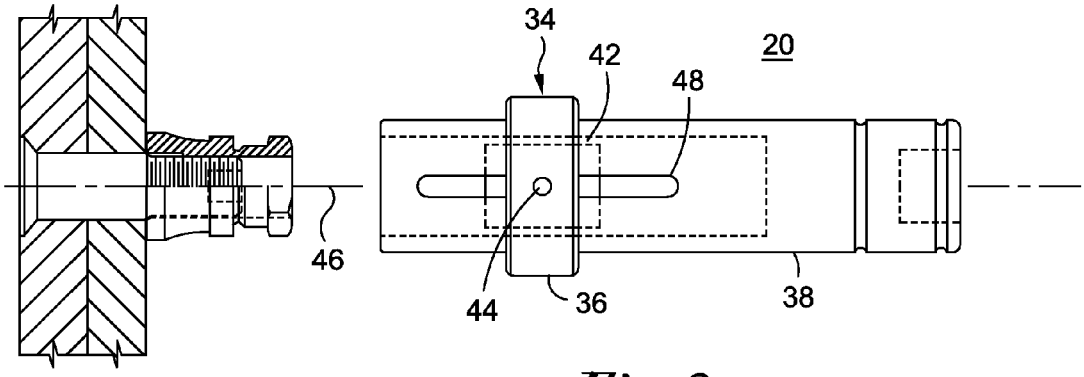
FIG. 3 is a side view of a socket in accordance with the present invention, in association with a frangible collar fastener.

As shown at FIG. 3, the nut ejection apparatus 34 further includes interior collar or ejector 42 which translates along the length of socket 20 in response to translation of exterior sleeve 36. Exterior sleeve 36 and interior sleeve 42 are substantially coaxial about centerline 46. Pin 44 (one through each slot) extends through exterior sleeve 36 and interior sleeve 42, connecting sleeves 36 and 42 to allow sleeves 36 and 42 to move in unison along the length of socket 20. In the presently preferred embodiment, at least 2 slots 48 are formed in the housing 38 (on opposing sides of the housing 38), and two pins 44 extend through each of exterior sleeve 36 and interior sleeve 42, placing sleeves 36 and 42 in mechanical communication to jointly translate along the length of slot 48 in response to translation of the exterior sleeve 36. FIG. 3 also illustrates a construction wherein the socket engaging aperture is formed on a separate housing segment which can be engaged to the socket, e.g. by thread engagement.

Figure 4:
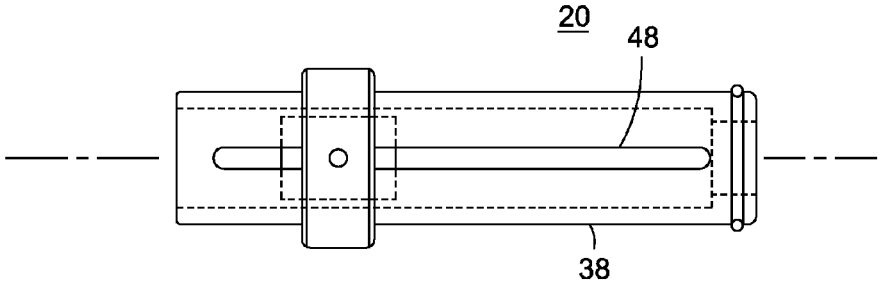
FIG. 4 is a side view of a socket in accordance with the present invention.

FIG. 4 illustrates an alternate embodiment of the socket 20 wherein the slot 48 extends substantially the length of the socket housing 38.

Figure 5:
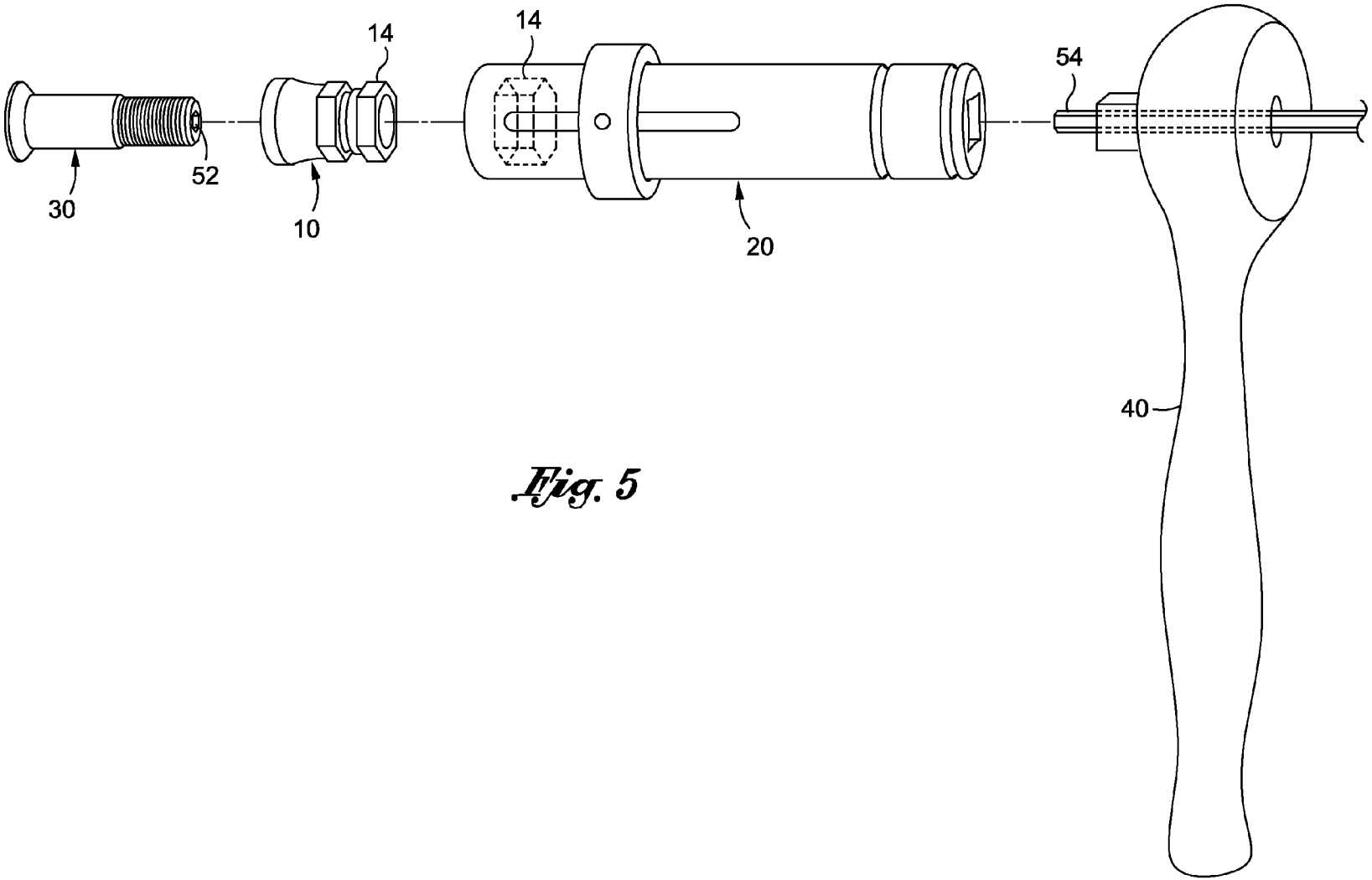
FIG. 5 is an exploded view of the socket in accordance with the present invention, in association with a ratchet, a hex wrench, a bolt and a frangible collar fastener.
Figure 6:
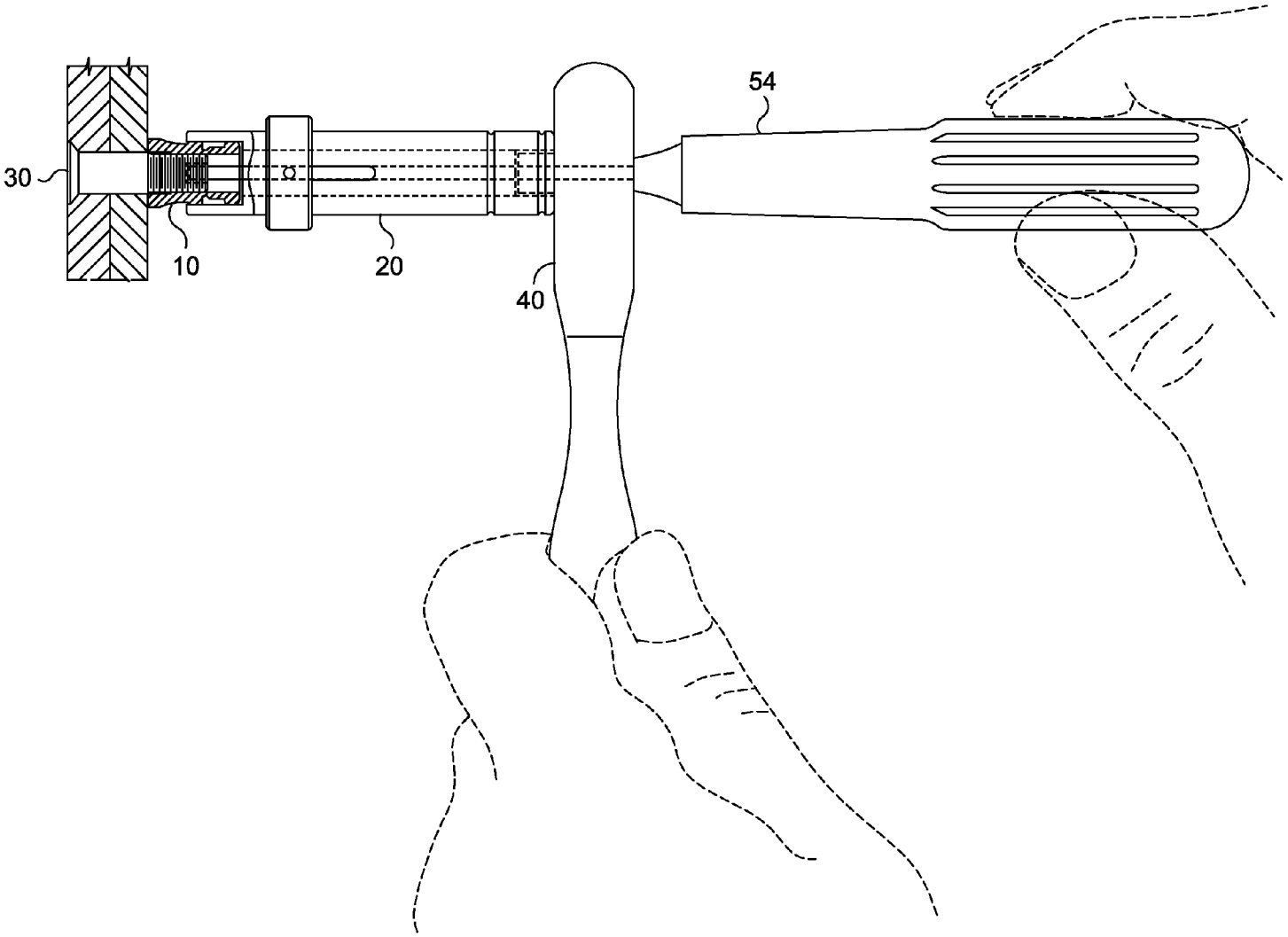
FIG. 6 is a side view showing a socket in accordance with the present invention in association with a ratchet, a hex wrench, a bolt and a frangible collar fastener.

FIGS. 5 and 6 illustrate use of the socket 20 in association with a frangible fastener 10 and bolt 34. In certain applications, rotation of the frangible fastener 10 onto a bolt may cause the bolt to rotate with the fastener, preventing the fastener 10 from being securely engaged to the bolt. Under those circumstances, the bolt, such as bolt 30, may be provided with a recess, such as hexagonal recess 52 which can receive and engage a hex wrench 54 which extends through the socket 20, interior sleeve 42, any nuts stored in the socket, and the fastener 10. In this manner, the bolt 30 may be secured from rotation with the fastener 10, to allow tight engagement between the fastener 10 and bolt 30.

FIG. 6 illustrates how the hex wrench 54 may be extended through the ratchet 40, socket 20 and fastener 10 in order to engage bolt 30. In practice, the ratchet 40 may be implemented as a Hy-Lok ratchet such as that marketed under the Snap-On brand, which features a hole through the head and ratchet square drive through which the hex fringe 54 may be extended as the fastener collar is tightened to the bolt 30.

What is claimed is:

1. A socket for securing frangible collar fasteners to bolts and collecting frangible nut portions separated from the fasteners to avoid introducing debris into the work area, the socket comprising:

(a) a socket housing having an open first end formed to receive and engage the frangible nut portions of the fasteners;

(b) at least one resilient retention member disposed within the socket housing, proximate the housing first end, the retention member being resiliently displaceable to allow each nut portion to enter into the socket housing and remain engaged to the retention member during fastening, and to retain a plurality of nut portions within the socket housing after the nut portions have been separated front the frangible collar fasteners, each nut portion entering the housing being effective to urge preceding nut portions to axially translate into the socket housing away from the socket housing first end, and out of engagement with any retention member;

(c) nut ejection apparatus having a first portion disposed exterior to the socket housing and a second portion disposed interior to the socket housing, the nut ejection apparatus being translatable along at least a portion of the socket length to receive and store a plurality of separated nut portions within the housing, and to urge each of the separated nut portions past the retention member and out of the socket first end.

2. The socket as recited in claim 1 wherein the socket housing further comprises at least one slot extending along as portion of the length of the socket housing, the nut apparatus extending through the slot to guide the translation of the nut ejection apparatus along the socket length.

3. The socket as recited in claim 2 wherein the nut ejection apparatus first portion comprises an exterior nut ejection sleeve disposed about the socket housing and translatable along at least a portion of the socket.

4. The socket as recited in claim 3 wherein the nut ejection apparatus second portion comprises an interior nut ejection sleeve disposed within the socket housing, the interior nut ejection sleeve being engaged to the exterior nut ejection sleeve and translatable therewith.

5. The socket as recited in claim 4 wherein the nut ejection apparatus further comprises at least one pin extending through the at least one slot, connecting the exterior nut ejection sleeve and the interior nut ejection sleeve.

6. The socket as recited in claim 1 further comprising a ratchet engaging aperture disposed on the socket housing second end, the socket being rotatable in response to rotation of the ratchet to tighten the fasteners and separate the frangible nut portions from the fasteners.

7. The socket as recited in claim 1 wherein the socket first end defines a substantially hexagonal interior chamber extending along or at least a portion of the socket length from the socket first end, the hexagonal chamber being formed to receive and store a plurality of the frangible nut portions.

8. The socket as recited in claim 7 wherein the socket second end defines a substantially rectangular interior chamber extending a portion of the socket length from the socket second end, the substantially rectangular chamber being defined to receive and engage a ratchet.

9. The socket as recited in claim 8 wherein the socket housing defines a central aperture extending from the socket second end to the socket first end to allow a hex wrench to extend therethrough to hold the bolt stationary as the socket is rotated to tighten the fasteners.

10. The socket as recited in claim 1 wherein the retention member is displaceable from a first position, wherein the retention member extends within the socket housing interior chamber, to a second position wherein the retention member is substantially flush with the socket housing.

* * * * *